US006896267B1

(12) United States Patent
Le Anna

(10) Patent No.: US 6,896,267 B1
(45) Date of Patent: May 24, 2005

(54) AUTOMATIC RESET TARGET

(75) Inventor: David Le Anna, Nashville, TN (US)

(73) Assignee: Do-All Traps, LLC, Nashville, TN (US)

( * ) Notice: Subject to any disclaimer, the term of this patent is extended or adjusted under 35 U.S.C. 154(b) by 49 days.

(21) Appl. No.: 10/656,447

(22) Filed: Sep. 5, 2003

(51) Int. Cl.[7] ..... F41J 7/04
(52) U.S. Cl. ..... 273/391
(58) Field of Search ..... 273/390–392

(56) References Cited

U.S. PATENT DOCUMENTS

| | | | | |
|---|---|---|---|---|
| 996,712 | A * | 7/1911 | Harper | 273/392 |
| 1,098,255 | A | 5/1914 | Harper | |
| 1,547,881 | A | 7/1925 | Lambert | |
| 1,657,931 | A | 1/1928 | Krantz | |
| 3,411,784 | A | 11/1968 | Lawrence | |
| 3,413,003 | A | 11/1968 | Bell | |
| 3,844,559 | A * | 10/1974 | Davidson et al. | 273/383 |
| 4,116,443 | A | 9/1978 | Dorfman | |
| 4,524,976 | A * | 6/1985 | Seitz et al. | 273/388 |
| 4,550,918 | A | 11/1985 | Motsenbocker | |
| 4,588,194 | A | 5/1986 | Steidle | |
| 4,714,256 | A | 12/1987 | Mosser | |
| 4,726,593 | A | 2/1988 | Wade | |
| 4,773,652 | A | 9/1988 | Mosser | |
| 4,949,980 | A * | 8/1990 | Hoy | 273/391 |
| 5,181,721 | A | 1/1993 | Halliburton | |
| 5,240,258 | A | 8/1993 | Bateman | |
| 5,263,722 | A | 11/1993 | Rosellen | |
| 5,324,043 | A | 6/1994 | Estrella | |
| 6,347,798 | B1 | 2/2002 | Quiring | |
| 6,502,820 | B2 * | 1/2003 | Slifko | 273/391 |

* cited by examiner

*Primary Examiner*—Mark S. Graham
(74) *Attorney, Agent, or Firm*—Miller & Martin PLLC

(57) ABSTRACT

A resettable target is provided with pivotable targets that rotate from a downward position to an upward position and are reset by reverse rotation when momentum is transmitted from a projectile to a reset target.

20 Claims, 5 Drawing Sheets

AUTOMATIC RESET TARGET

BACKGROUND OF THE INVENTION

This invention generally relates to a multiple target apparatus and, more particularly, to a target apparatus with a plurality of pivotable targets that are meant to rotate or pivot around a central axis from a lower to an upper or prone position from the impact of a bullet or other projectile. The individual targets are then returned to their lower position from the impact of a bullet upon a reset target reversely pivoting and resetting the pivotable targets for continued shooting.

Rifles, pistols and shotguns are used to shoot bullets or similar projectiles at targets both for the practice of marksmanship and in competitions. Characteristics of targets used in these activities generally include clearly visible and easily identifiable areas of desired impact, commonly referred to as bull's-eyes, a means for determining the point of impact of the bullet or projectile, and the ability to change or reset targets. A significant convenience to target shooters is the ability to shoot continuously at the bull's-eye without having to manually change or reset targets.

Another convenience is the ability to clearly and easily determine when a bull's-eye has been struck.

An added convenience to target shooters is the ability to transport and position targets with ease.

Automatically resettable targets have been developed in various configurations, but all are lacking the features or simplicity of operation desired by marksmen. For example, see U.S. Pat. Nos. 996,712; 1,098,255; 1,348,540; 3,227,442; 4,773,652; 5,324,043; and 6,347,798. The latter design for instance requires the use of two horizontal bars to support targets after being struck by a projectile.

SUMMARY OF THE INVENTION

An object of this invention is to provide a multiple target apparatus having one or more pivotable targets that pivot out of their pre-shot, downward position from the impact of a bullet to an upper position and a reset target to return the pivotable targets to their lower position, also utilizing energy transfer from the impact of a bullet.

Another object of this invention is to provide a means for continuously shooting at individual targets without the necessity of manually resetting targets to a pre-shot position.

A further object of this invention is to provide a non-mechanical mechanism that utilizes projectile momentum to cause the pivotable targets to be returned to their lower position.

Still another object of this invention is to provide a compact, transportable target apparatus that can be positioned quickly and easily with a readily attachable three-point base supporting the target apparatus.

A still further object of this invention is to provide an automatic reset target with a single horizontal target support bar.

In keeping with these objects, and others which will become apparent hereinafter, one feature of this invention resides in a target apparatus with a plurality of pivotable targets which rotate from their normal downward position upon the impact of a bullet to an upward position. Said pivotable targets may be returned to their downward position by a unique reset mechanism that is also activated by the impact of a bullet. The reset apparatus comprises a non-mechanical means using the bullet's momentum to reset the pivotable targets simultaneously downward after one or more of such targets have been pivoted to an upward position.

In operating the multiple target apparatus, the small disk or bull's-eye of each individual pivotable target is mounted to the horizontal target bar and is consecutively struck by a bullet. The impact of the bullet transfers momentum to the struck target, causing the pivotable target to swing backwards and upward through an arc of over 180°, until halted by and resting upon the catch pins attached to the horizontal target bar. After one or more of the pivotable targets has been rotated to its upward position, the impact of a bullet upon the automatic reset target causes the reset target to rock backward. The linear momentum of the reset target is transferred to angular momentum of the horizontal target bar and its catch pins, sufficient to rotate all the pivotable targets into their downward positions simultaneously, thus resetting the target apparatus for additional target shooting.

The novel features which are considered as characteristic of the invention are set forth in particular in the appended claims. The invention itself, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
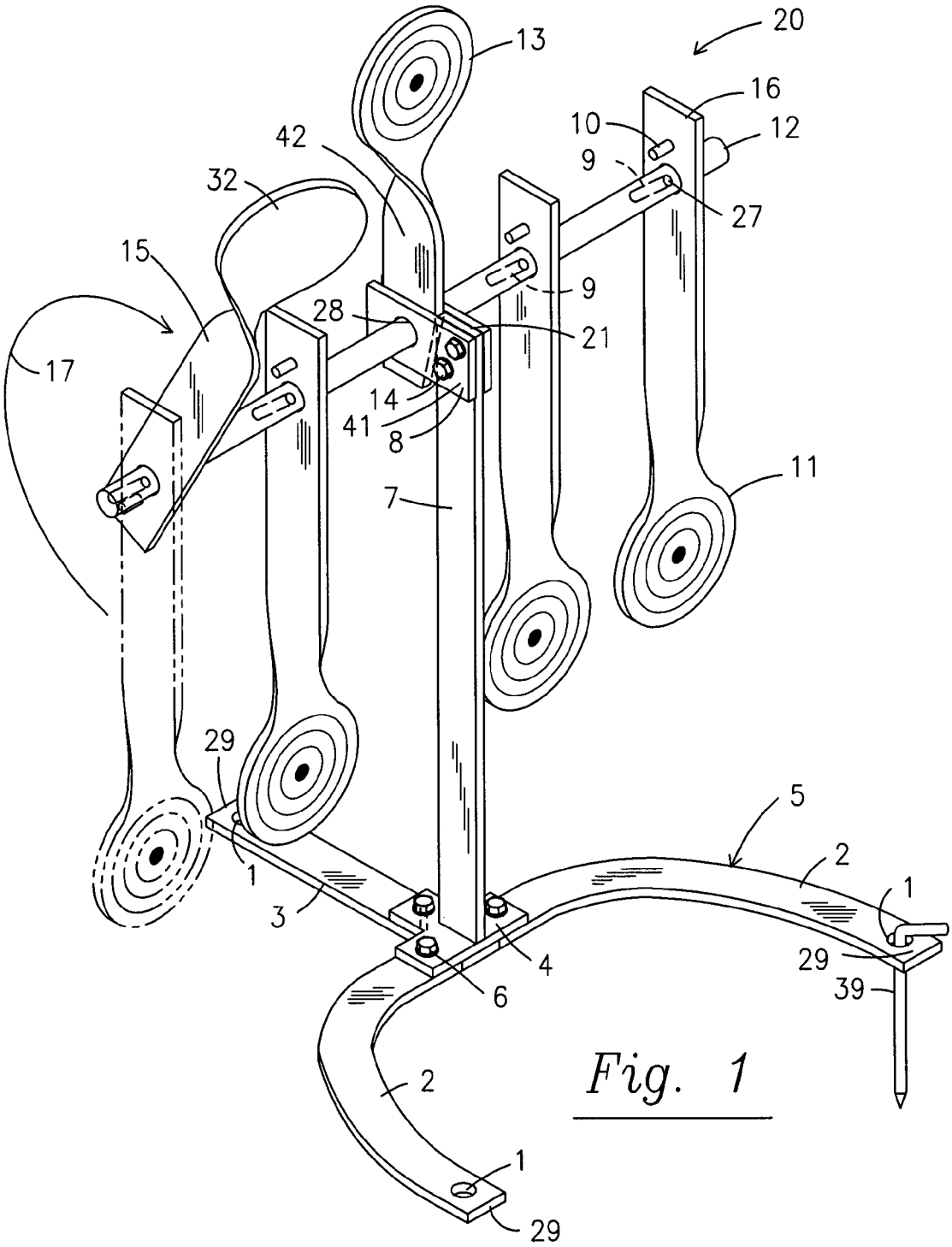
FIG. 1 is a perspective view depicting a typical configuration of a target apparatus according to the invention.
Figure 2:
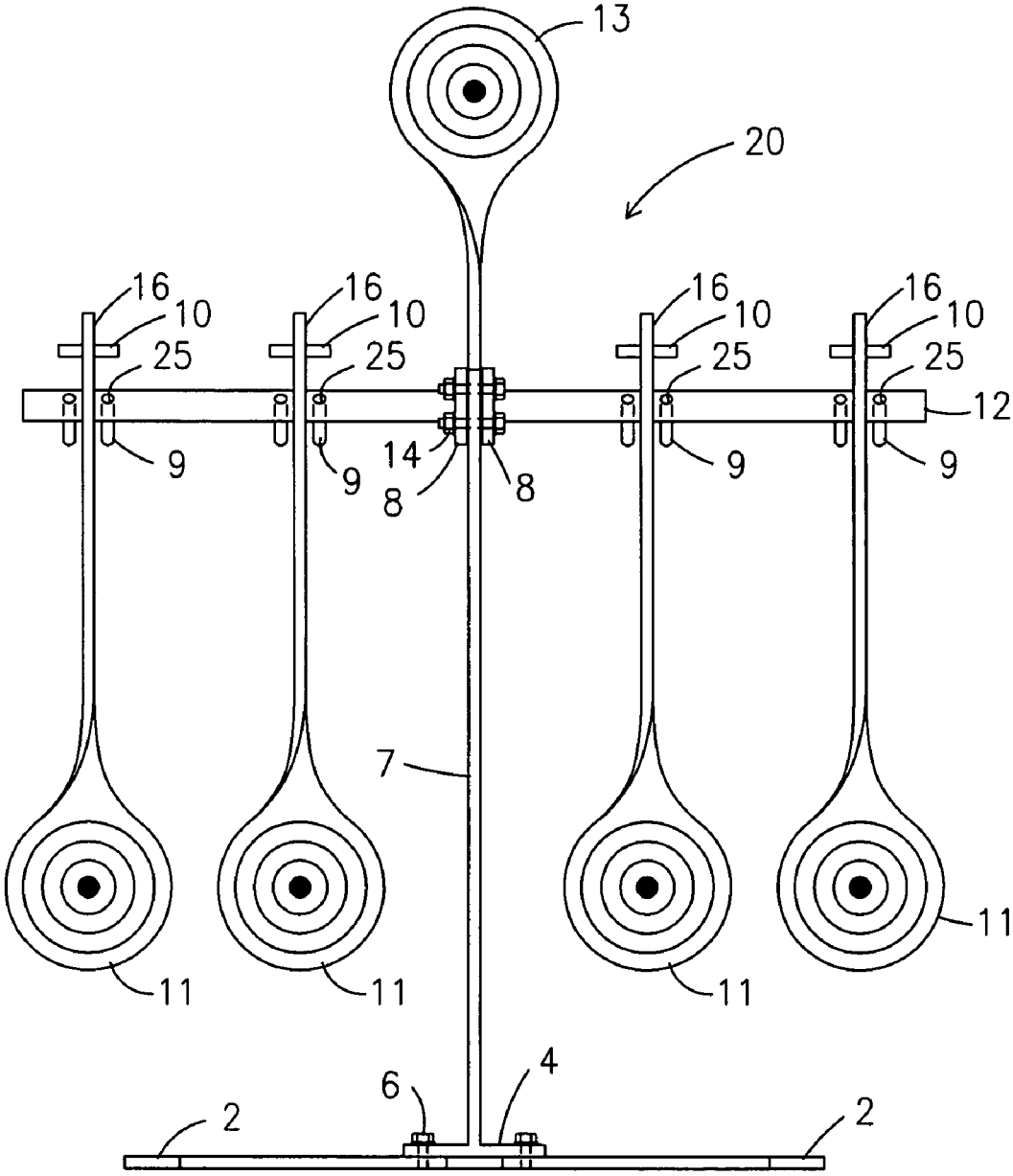
FIG. 2 is a front plan view of the target apparatus according to this invention, showing all the pivotable targets in their downward position.

Turning to FIG. 2, the auto-reset target apparatus 20 is illustrated from a front view revealing the pivotable targets 11 in their downward or pre-shot positions. Pivotable targets 11 are preferably fabricated from metal or similar material to be resistant to damage from gun fire. Different thicknesses and hardnesses of metal may be employed depending upon the caliber and velocity of bullets intended for use with the targets. The auto-reset target 20 is supported by a three-pronged base 5 best seen in FIGS. 1 and 4, having two forward legs 2 and one rear leg 3 forming a "Y" shape. The base design is only one of many possible designs appropriate for supporting the target apparatus 20 to prevent undue movement as shots fired at the targets 11,13 tend to rock the target apparatus 20 rearward. Spike holes 1 positioned at the terminal end 29 of each of the three legs 2,3 serve to receive spikes 31 to hold the target apparatus 20 in place when placed on turf. A weighted object such as a stone or brick may be used to weight the legs 2,3 and hold the target apparatus 20 in position when the target is placed on ground unsuitable for use of spikes such as a concrete surface. Alternative base configurations with three or more legs are also suitable.

In the illustrated embodiment of FIG. 1, a vertical support base 4 attaches vertical support 7 to the base 5. Three support bolts 6 are used to secure the support base 4 of vertical support 7 to the base 5. The bolts 6 are easily removed, either with a wrench or by hand, especially if wing nuts are employed, which allows the target apparatus 20 to be quickly and easily disassembled for transport.

Figure 4:
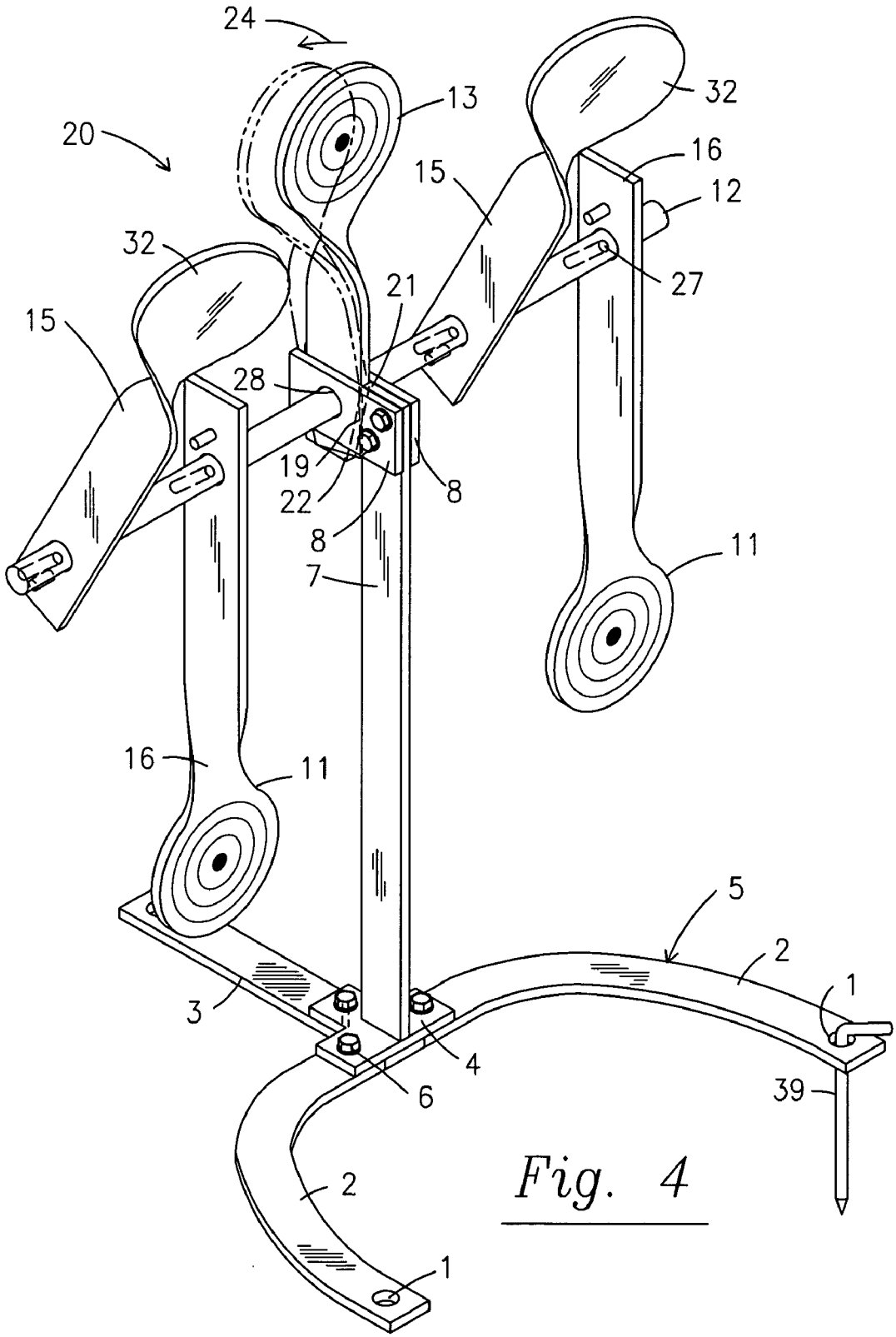
FIG. 4 is a perspective view depicting in phantom the range of motion for the reset target.

The upper end 21 of vertical support 7 is attached to horizontal support bar 12 by sandwiching means such as latch pair 8. First ends 41 of latch pair 8 sandwich the proximal end 21 of the vertical support 7 while second ends 42 of latch pair 8 sandwich the central reset target 13 and also receive and support horizontal support bar 12. Latch bolts 14 are used to attach first ends 41 of latch pair 8 to the vertical support 7. Holes 28 in second ends 42 of latch pair 8 receive the horizontal support bar 12. The holes 28 have sufficient diameter to allow the horizontal support bar 12 to rotate when seated therein. As best seen in FIG. 4, rotation of the horizontal support bar 12 is limited by the reset target 13, which is welded, or otherwise fixedly mounted, to the horizontal support 12. Since reset target 13 is also sandwiched between second ends 42 of latch pair 8, the lateral movement of horizontal support bar 12 is thereby constrained. If a sandwiching structure is not uses, it will generally be necessary to have two vertical supports to hold the horizontal bar 12.

Figure 3:
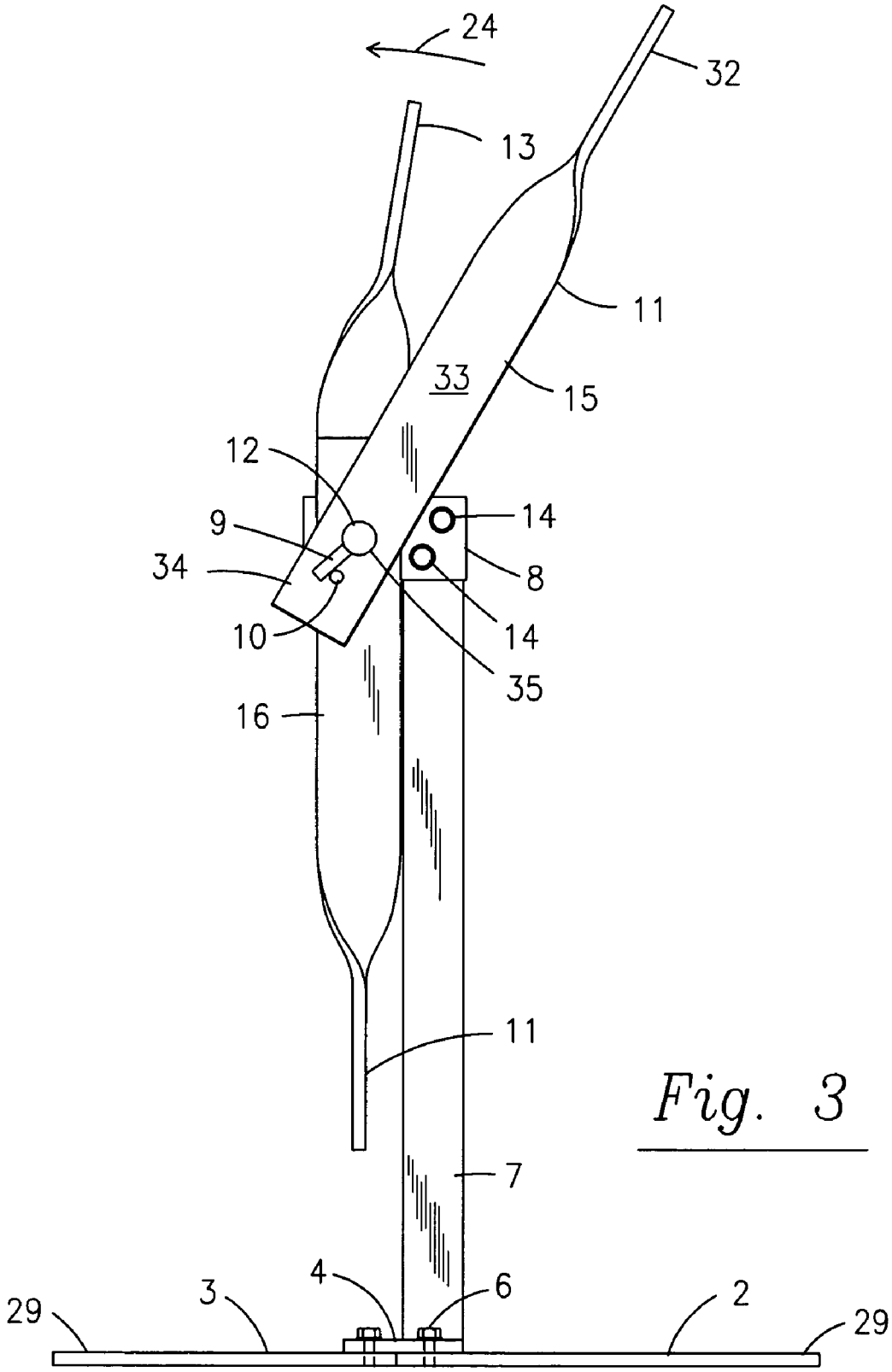
FIG. 3 is a side plan view of the invention with one of the pivotable targets in the upward position.
Figure 5:
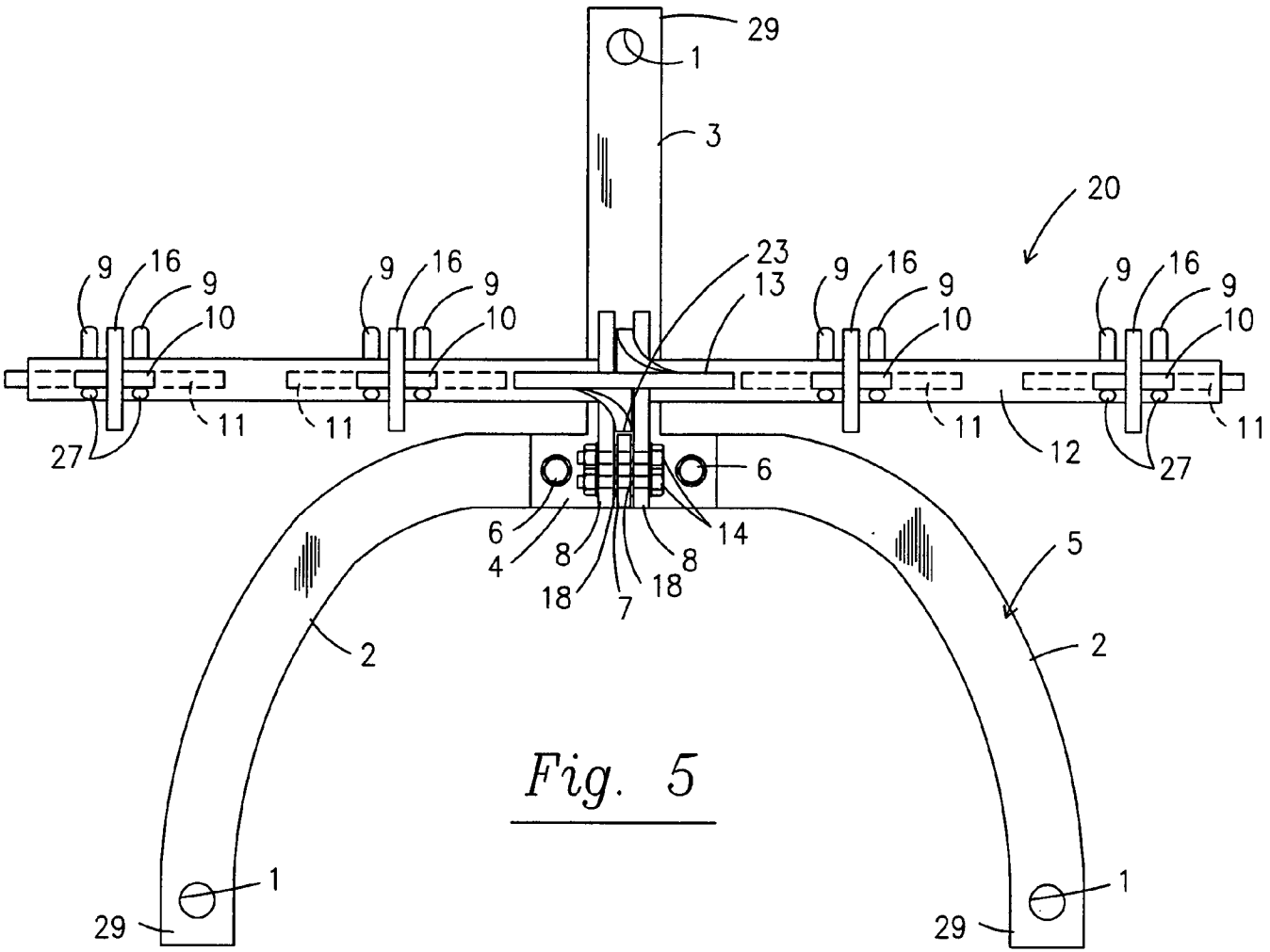
FIG. 5 is a top plan view of the reset target portion of the invention.

A plurality of pivotable targets 11 are mounted on the horizontal support bar 12. FIG. 3 shows a side view of a pivoting target 11 in an upright position 15. The pivoting target 11 has an arm 33 with proximal end 34 and distal bull's-eye end 32. In the proximal end 34 is aperture 35 to receive horizontal support bar 8. Also attached to proximal end 34 is a detent such as stop pin 10. Preferably, a stop pin 10 is on each side of the proximal end 34. In a preferred embodiment, an equal number of targets 11 are placed on either side of the reset target 13. FIG. 2 shows a reset target apparatus 20 with two pivoting targets 11 on each side of the central reset target 13. Pairs of catch holes 27, best seen in FIG. 5 where holes 27 pass through the support 12, are placed along the horizontal support 12 and receive catch pins 9 which protrude on one side of support 12 and serve as detents to restrict the lateral and rotational movement of targets 11. The individual targets 11 are mounted on the horizontal support 12 by sliding the target arm aperture 35 along the horizontal support 12 until it is placed between a pair of catch holes. Once the proximal end 34 of target 11 is positioned, catch pins 9 can be inserted into the catch holes 27 preventing the target arm 11 from moving laterally along the horizontal support 12. When targets 11 are rotated about the horizontal bar 12, catch pins 9 engage with stop pins 10 to prevent the targets from a full 360 degrees of rotation about the bar 12.

Referring now to FIG. 1, a multiple target apparatus 20, illustrates a typical use of the invention. A projectile strikes one of the pivotable targets 11 on its nose or bull's-eye 32, causing the target 11 to be thrown back and up to an upward or prone position 15, from its original position shown in phantom. Pivotable targets 11 rotate from their downward positions through a reverse arc 17 of more than 180° to their upward position. From the view of FIG. 1, the pivotable targets 11 will move in a clockwise rotation through arc 17. After some or all of the pivotable targets 11 are struck in this manner, striking reset target 13 with a projectile causes the upward positioned 15 pivotable targets to be rocked backward and fall through a reverse arc, in a counterclockwise direction, into their downward position, thus resetting the target apparatus 20 for further shooting.

Turning now to FIG. 3, the target apparatus 20 is illustrated from a side plan view showing one of the individual target arms 11 in an upward position 15. The prone target 32 has been struck by a projectile pushing the target 32 to rotate backwards 17, as shown in FIG. 1, and around the horizontal support through an arc of more than 180 degrees (and preferably less than 270 degrees) until stop pin 10 protruding from arm 16 comes to rest on catch pin 9. Arrow 17 in FIG. 1 indicates the counter-clockwise motion of the target 32. Projectiles may hit the remaining individual targets 11 in the downward position until all targets are in the upward or prone position 15 or the shooter may choose to reset the upward target 15 or targets at any time by striking the reset target 13.

FIG. 4 illustrates the range of motion for the central reset target 13 and the momentum transfer associated with resetting targets from the upward position 15 to downward position 16. At rest, the central reset target 13 tilts forward approximately 10–30 degrees from the vertical support 7, as shown in FIG. 3. The tilt angle is dictated by another detent interface, or in the illustrated embodiment by the contact point 19 where the proximal end 22 of the reset target 13 contacts the proximal end 21 of vertical support 7. Detent positions other than on the proximal end 22 of the reset target extending below the horizontal bar 12 may also be employed. Indeed, the proximal end of reset target 13 may simply be fixed to the horizontal bar 12 and need not have an end extending beyond the bar 12. When a projectile strikes the reset target 13, the target is pushed backward as indicated by arrow 24. Because the reset target 13 is fixedly mounted to the horizontal support bar 12, the linear motion 24 of reset target 13 is converted into angular motion or rotation of horizontal support bar 12. From the views of FIGS. 1, 3 and 4, it will be seen that the rotation is in a counterclockwise direction. The rotation of horizontal support bar 12 causes rotation of catch pins 9. Because the stop pins 10 of any pivoting targets 11 in upward position 15 are resting on catch pins 9, the rotation of catch pins 9 causes the stop pins 10 and associated pivoting targets to rotate counterclockwise. Once the pivoting targets 11 move past vertical, gravity causes those targets to swing downward about the horizontal support bar 12 until the bull's-eye portions 32 are again in their downward positions 16.

It will be seen that the backward motion 24 of reset target 13 is constrained by contact with the proximal end 21 of vertical support 7. Preferably at this point of contact, the reset target 13 still has at least a slight orientation forward from the vertical. This forward orientation places the mass of bull's-eye of reset target 13 forward of the horizontal support bar 12. Gravity acting upon the mass of the reset bull's-eye will tend to rotate the horizontal support bar 12 until the reset target 13 is in its rest position, constrained by contact of another detent, the shaft 48 of the reset target 13, with the vertical support 7. Accordingly, the rest target will generally move through an arc of less than 45 degrees, and preferably less than 30 degrees.

While the preferred embodiments of the invention have been described above in detail, it is to be understood that variation and modifications can be made therein without departing from the spirit and scope of the present invention as set forth in the following claims. It is the aim of the appended claims to cover all changes and modifications that may be made without departing from the spirit and scope of the invention.

What is claimed is:

1. A resettable target device comprising:

a base;

a vertical support extending upward from the base;

a horizontal bar mounted perpendicular to the vertical support and having a first detent extending therefrom;

a target having a proximal end mounted on the horizontal bar so that the target is pivotable through an arc of over 180° about the horizontal bar, said target having a second detent cooperating with the first detent to prevent the target from pivoting through an arc of 360°, and said target further having a distal end; and a reset target fixed to the horizontal bar so that movement of the reset target rotates the horizontal bar.

2. The resettable target device of claim 1 wherein the first detent comprises at least one catch pin.

3. The resettable target device of claim 1 wherein the second detent comprises at least one stop pin.

4. The resettable target device of claim 1 wherein the reset target extends upwardly from the horizontal bar and its rotational movement is constrained to an arc of less than 45°.

5. The resettable target device of claim 1 wherein a latch plate mounted to the vertical support has an aperture to receive the horizontal bar.

6. The resettable target device of claim 1 wherein a detent fixed to the horizontal bar restricts the rotation of said bar to less than about 30 degrees.

7. The resettable target device of claim 4 wherein the reset target is sandwiched between two plates having apertures through which the horizontal bar passes.

8. The resettable target device of claim 1 wherein at least one pivotable target is located on the horizontal bar on either side of the reset target.

9. The resettable target device of claim 1 wherein the reset target protrudes from the horizontal bar at a forward tilt of between about 10 to about 30 degrees.

10. The resettable target device of claim 9 wherein the forward tilt of the reset target is constrained by a third detent.

11. The resettable target device of claim 10 wherein the rearward direction is constrained by a fourth detent.

12. A method of target shooting utilizing a resettable target device of the type having a horizontal bar with a first detent extending therefrom, a target having a proximal end mounted on the horizontal bar so that the target is pivotable through an arc of over 180° about the horizontal bar, said target having a second detent cooperating with the first detent to prevent the target from pivoting through an arc of 360°, and said target further having a distal end extending to a downward position beneath the horizontal bar, and a reset target affixed to the horizontal bar and extending upward from said horizontal bar so that movement of the reset target rotates the horizontal bar and the first detent extending therefrom, comprising the steps of:

firing a first projectile to contact the target extending downward from the horizontal bar and thereby rotating said target rearward through an arc of over 180° until the first and second detents halt the rotation of the target in an upward position; and firing a subsequent projectile to contact the reset target and thereby move the reset target rearward from its upward position to communicate rotation to the horizontal bar and its associated first detent thereby transmitting rotation to the second detent and its associated target with sufficient force that the target returns to its original downward position.

13. The method of target shooting utilizing a resettable target device of claim 12 wherein a plurality of downward extending targets are struck by projectiles and rotated to an upward position before the projectile is fired to contact the rest target.

14. The method of target shooting utilizing a resettable target device of claim 12 wherein the reset target's rearward movement is constrained so that less than about 30 degrees of rotation is communicated to the horizontal bar.

15. A resettable target device comprising:

a base means;

a vertical support means extending upward from the base means;

a horizontal bar mounted perpendicular to the vertical support means;

a target means having a proximal end mounted on the horizontal bar for rotational movement and an opposite distal end;

a reset target fixed to the horizontal bar in an upward position so that movement of the reset target rotates the horizontal bar; and wherein the horizontal bar and target means have cooperating detent means permitting said target to swing about the horizontal bar through an arc of over 180° but less than 360° of rotation.

16. The resettable target device of claim 15 wherein the reset target is constrained with sandwiching means.

17. The resettable target device of claim 16 wherein the sandwiching means have apertures to receive the horizontal bar.

18. The resettable target device of claim 15 wherein a detent means constrains the rotational movement of the reset target.

19. The resettable target device of claim 15 wherein a detent means constrains the rotational movement of the horizontal bar.

20. The resettable target device of claim 18 wherein the rotational movement of the reset target is constrained to an arc between the vertical and thirty degrees forward of the vertical.

* * * * *